US006904770B2

(12) United States Patent
Telesz et al.

(10) Patent No.: US 6,904,770 B2
(45) Date of Patent: Jun. 14, 2005

(54) MULTI-FUNCTION CONDENSER

(75) Inventors: John Paul Telesz, East Amherst, NY (US); Edward Douglas Pettitt, Burt, NY (US); Scott Edward Kent, Albion, NY (US); David A. Southwick, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 104 days.

(21) Appl. No.: 10/654,070

(22) Filed: Sep. 3, 2003

(65) Prior Publication Data

US 2005/0044884 A1 Mar. 3, 2005

(51) Int. Cl.[7] ..... F25B 39/04; F25B 43/00; F25B 41/00; F25B 43/04

(52) U.S. Cl. ..... 62/509; 62/474; 62/475; 62/503; 62/513

(58) Field of Search ..... 62/503, 509, 513, 62/474, 475

(56) References Cited

U.S. PATENT DOCUMENTS 4,972,683 A * 11/1990 Beatenbough ..... 62/507
5,088,294 A 2/1992 Ando ..... 62/119
5,146,767 A 9/1992 Kadle et al. ..... 62/474
5,379,833 A * 1/1995 Mathews ..... 165/113
5,927,102 A 7/1999 Matsuo et al. ..... 62/509
6,044,900 A * 4/2000 Kawahara ..... 165/110
6,360,560 B1 3/2002 Whitlow et al. ..... 62/509
6,470,703 B2 * 10/2002 Wada et al. ..... 62/509
6,615,608 B1 9/2003 Telesz et al.
6,615,610 B1 9/2003 Pettitt et al.

* cited by examiner

*Primary Examiner*—Cheryl Tyler
*Assistant Examiner*—Filip Zec
(74) *Attorney, Agent, or Firm*—Patrick M. Griffin

(57) ABSTRACT

A multi-function condenser for an air conditioning system includes a first header, a second header, a plurality of tubes, and a conduit. The tubes extend in parallel relationship between the headers for establishing fluid communication between the first header and the second header. The second header includes a header portion and a receiver portion. A conduit extends into and out of and is surrounded by the receiver portion to define a space between the conduit and the receiver portion. Heat is transferred between hot refrigerant flowing in the receiver portion, the header portion, and cooler refrigerant flowing through the conduit as the refrigerant flows through the conduit independently of the refrigerant flowing in the space and in the header portion to increase an overall efficiency of the air conditioning system.

34 Claims, 6 Drawing Sheets

FIG - 6
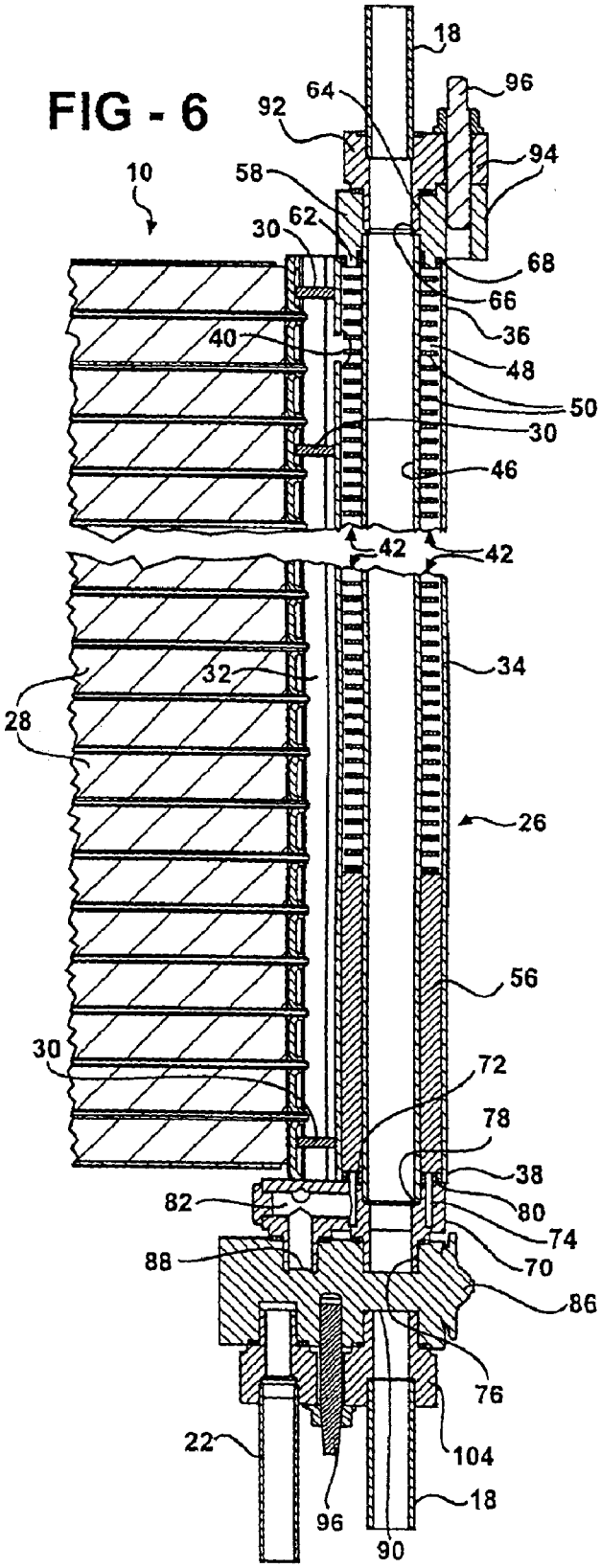
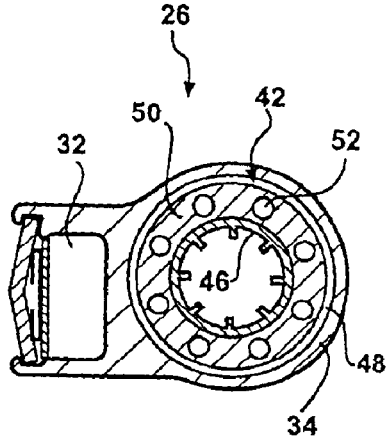
FIG - 7

MULTI-FUNCTION CONDENSER

BACKGROUND OF THE INVENTION

1. Field of the Invention

The subject invention relates to a multi-function condenser for use in an air conditioning system of a motor vehicle. More specifically, the subject invention relates to a multi-function condenser that transfers heat directly between refrigerant flowing from an evaporator and refrigerant flowing from a condenser.

2. Description of the Prior Art

A condenser for an air conditioning system of a motor vehicle is known in the art. In fact, a condenser having an integral receiver has been documented for use in air conditioning systems, which also include a refrigerant, a refrigerant compressor, an expansion device, and an evaporator. The receiver receives and stores condensed refrigerant from the condenser for flow into the expansion device where the refrigerant is allowed to expand.

A suction line of the air conditioning system extends between the evaporator and the compressor to return the refrigerant from the evaporator, where the refrigerant is essentially a gas, through the suction line and to the compressor for re-circulation. It is well known that the refrigerant flowing through the suction line is much cooler than refrigerant in the receiver, which in turn is cooler than refrigerant flowing in the condenser.

The refrigerant flowing through the suction line is pressurized by the compressor, which heats the refrigerant, before flowing into the condenser. This is done so that the refrigerant can be condensed into a liquid state by cooling the refrigerant with ambient air, regardless of a temperature of the ambient air. Because of the high pressure of the refrigerant in the condenser, the refrigerant may be condensed even at relatively high temperatures. A differential between energy of the refrigerant flowing into the compressor and a desired energy of the refrigerant flowing out of the compressor dictates an amount of energy the that the compressor must add to the refrigerant.

Refrigerant flows through the condenser to be sufficiently cooled and condensed into a liquid state before flowing to the evaporator. A temperature of the refrigerant exiting the condenser correlates to how cool the refrigerant can get when flowing through the expansion device, where the liquid refrigerant vaporizes and absorbs heat. Thus, it is advantageous to remove as much heat as possible from the refrigerant in the condenser to condense the refrigerant and to lower the energy of the refrigerant as much as possible.

Consequently, conventional air conditioning systems waste energy by thermodynamically separating the refrigerant flowing through the suction line, which must be energized, and the refrigerant flowing through the receiver and the condenser, which must be de-energized.

Furthermore, conventional air conditioning systems are expensive because the systems require the evaporator, the condenser, the compressor, the receiver, and all connecting lines be assembled during production, resulting in a lengthy assembly time, thus presenting a high cost not only for parts but for manpower to assemble the system. With so many components, there is a tendency toward misassembly of the systems. Such assembly also presents plumbing problems, with many points where leaks could develop within the system.

In addition, air conditioning systems generally produce pressure pulsations in the refrigerant as the refrigerant vaporizes in the evaporator. The pressure pulsations travel through the refrigerant flowing through the suction line and create noise that may be audible outside of the air conditioning system. The air conditioning systems require a muffler to attenuate the pressure pulsations and reduce noise. The mufflers add cost to production of the air conditioning systems.

Due to the inadequacies of the prior art, including those described above, it is desirable to provide a condenser that is multi-functional. More specifically, it is desirable to provide a condenser that, in addition to having an integral receiver, incorporates a conduit disposed in the suction line and passing through the condenser to transfer heat energy between the refrigerant in the condenser and the refrigerant in the suction line. It is also desirable to provide a condenser that is multi-functional to decrease an overall cost of the air conditioning system by eliminating a need for a muffler, while inhibiting misassembly by reducing parts and reducing assembly time for the system.

SUMMARY OF THE INVENTION AND ADVANTAGES

A condenser for an air conditioning system is disclosed. The condenser includes a first header, a second header, a plurality of tubes, and a conduit. The tubes extend in parallel relationship between the headers for establishing fluid communication between the first header and the second header. The conduit extends into and out of and is surrounded by the second header. A space is defined between the conduit and the second header for transferring heat between refrigerant flowing in the second header and the conduit as refrigerant flows through the conduit independently of refrigerant flowing in the space in the second header surrounding the conduit.

Accordingly, the subject invention provides the multi-function condenser that, in addition to condensing the refrigerant, includes the conduit passing through the condenser, specifically the second header, to extract heat energy from refrigerant flowing through the condenser and to add heat energy to the refrigerant flowing through the conduit to a compressor.

The subject invention further provides the multi-functional condenser that incorporates multiple parts of the air conditioning system, such as the receiver and an expansion device, to decrease an overall cost of the system. By including the multiple parts in the condenser, assembly time is reduced, a tendency toward misassembly is inhibited, a number of points where leaks could develop are decreased, and accessibility to the parts is improved.

The subject invention further attenuates pressure pulsations in the refrigerant flowing through the conduit to eliminate a need for a separate muffler, thus further reducing cost for the system.

BRIEF DESCRIPTION OF THE DRAWINGS

Other advantages of the present invention will be readily appreciated as the same becomes better understood by reference to the following detailed description when considered in connection with the accompanying drawings wherein:

FIG. 6 is a partially cross-sectional side view of the alternative multi-function condenser of FIG. 4; and FIG. 7 is a cross-sectional top view of a second header of the multi-function condenser.

DETAILED DESCRIPTION OF THE PREFERRED EMBODIMENT

Referring to the Figures, wherein like numerals indicate like or corresponding parts throughout the several views, a multi-function condenser is generally disclosed at 10. For descriptive purposes only, the multi-function condenser 10 is hereinafter referred to as "the condenser".

Figure 1:
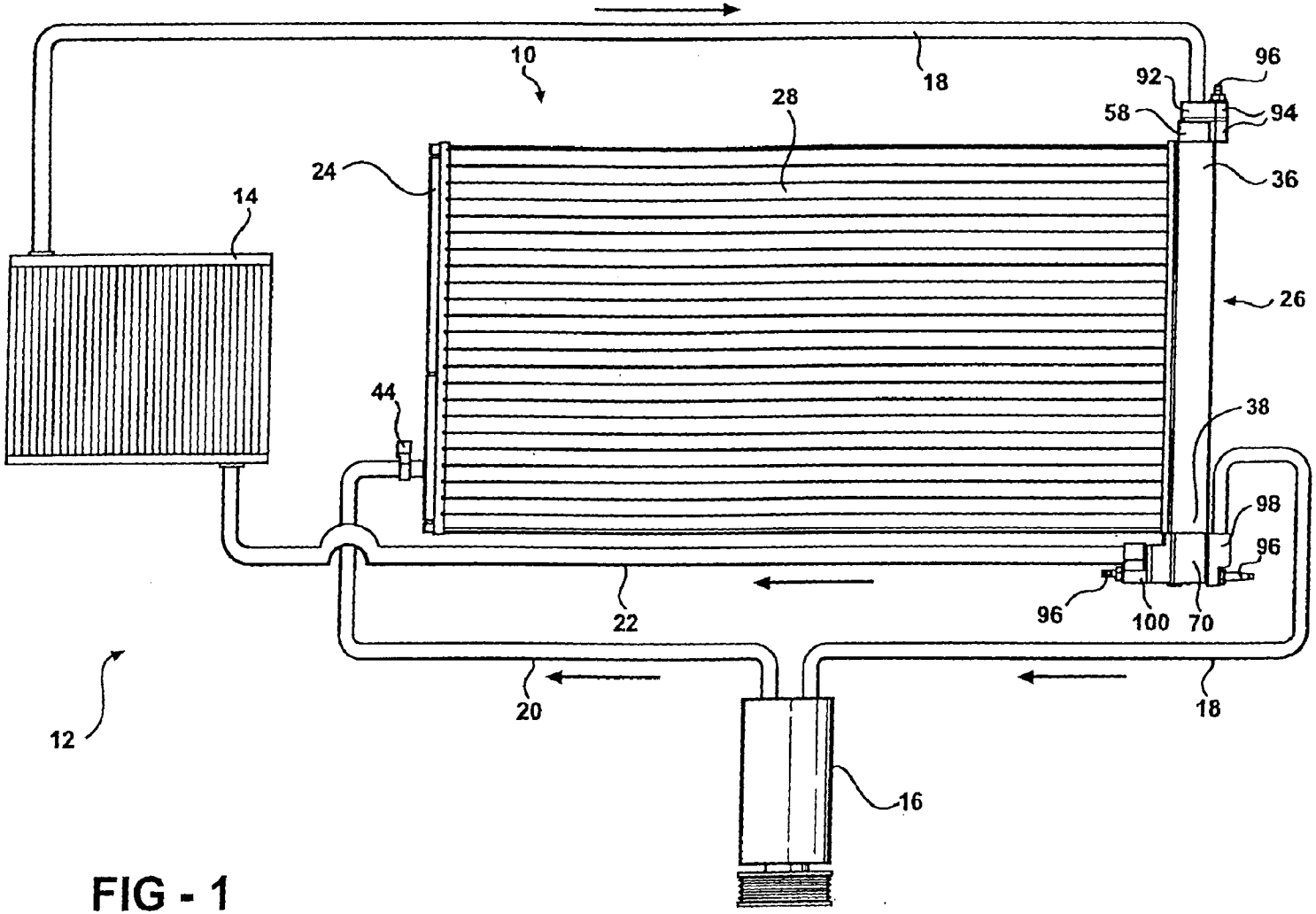
FIG. 1 is a schematic view of an air conditioning system illustrating a compressor, an evaporator, and a multi-function condenser.
Figure 2:
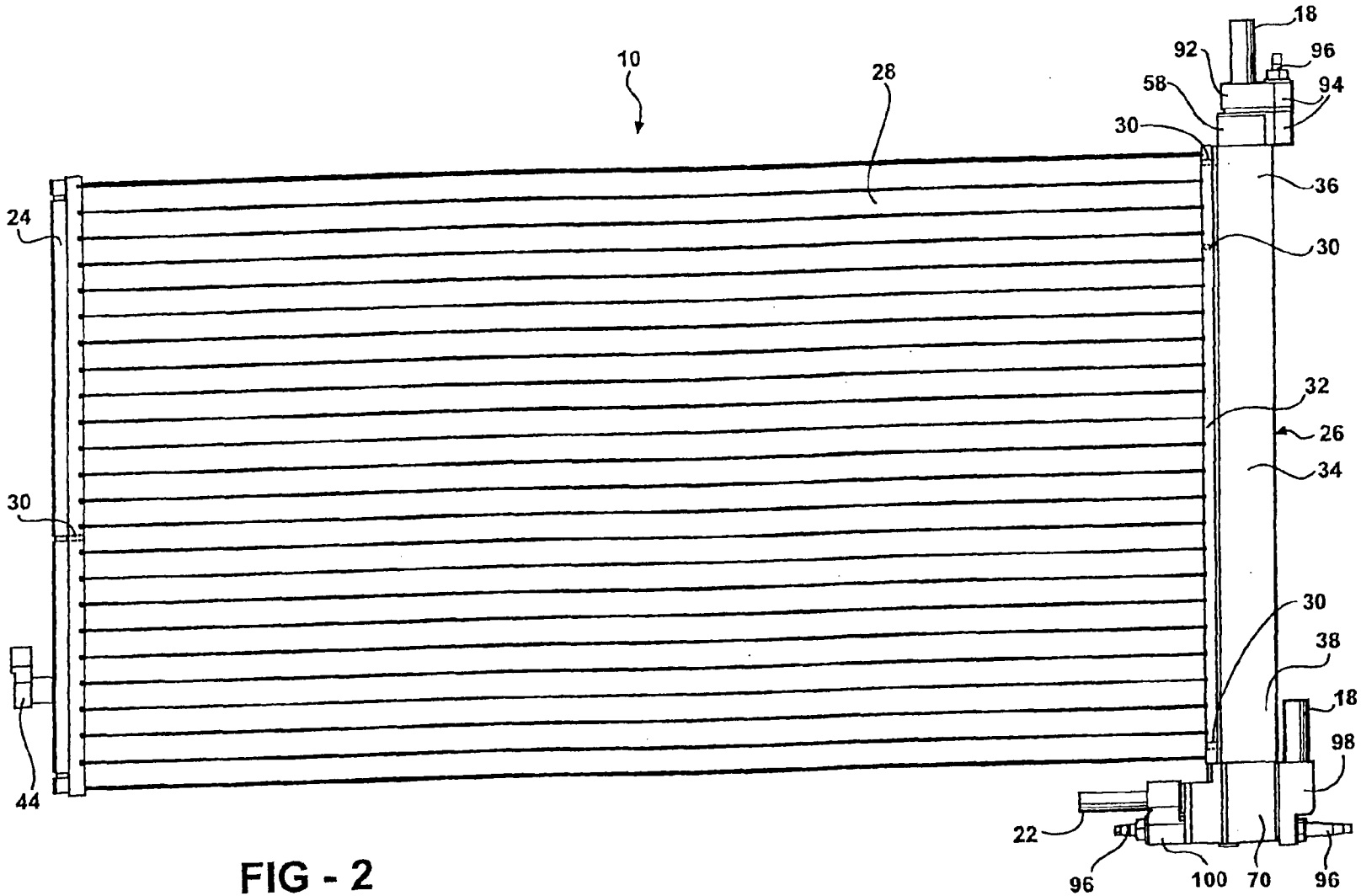
FIG. 2 is a front view of the multi-function condenser of FIG. 1.

Referring specifically to FIG. 1, the condenser 10 is used in an air conditioning system, which is shown generally at 12. The air conditioning system 12 includes an evaporator 14 for vaporizing a refrigerant flowing into the evaporator 14 to cool air that is flowing around an exterior of the evaporator 14. A compressor 16 pressurizes the refrigerant flowing into the compressor 16, which heats the refrigerant to a temperature that is much higher than ambient air temperatures, even on relatively hot days. This allows the condenser 10 to condense the refrigerant into a liquid state by removing heat from the refrigerant with the ambient air. Because of the increased pressure of the refrigerant in the condenser 10, the refrigerant may be condensed even at relatively high temperatures. A suction line 18 is disposed between the evaporator 14 and the compressor 16. The refrigerant flows through the suction line 18 from the evaporator 14 to the compressor 16. A pressurized refrigerant line 20 is disposed between the compressor 16 and the condenser 10. The refrigerant flows from the compressor 16 through the pressurized refrigerant line 20 to the condenser 10, where a phase of the refrigerant changes from a vapor to a liquid due to the removal of heat by the condenser 10. An evaporator inlet line 22 is disposed between the condenser 10 and the evaporator 14. The refrigerant flows from the condenser 10 through the evaporator inlet line 22 to the evaporator 14 to allow for a repetitious cycle of heating and cooling of the refrigerant flowing through the system 12.

The condenser 10 includes a first header 24, a second header 26, and a plurality of tubes 28 extending in parallel relationship between the headers 24, 26 for establishing fluid communication between the first header 24 and the second header 26. A plurality of dividers 30 are disposed in the first header 24 and the second header 26. The dividers 30 divide the tubes 28 into groups and direct refrigerant flow in a serpentine path through the tubes 28 between the headers 24, 26. The dividers 30 thus prevent the refrigerant from flowing into the first header 24 and exiting through the second header 26 after making only one pass through the tubes 28. By flowing the refrigerant in a serpentine path through the tubes 28, the refrigerant is substantially cooled before exiting the condenser 10.

Figure 3:
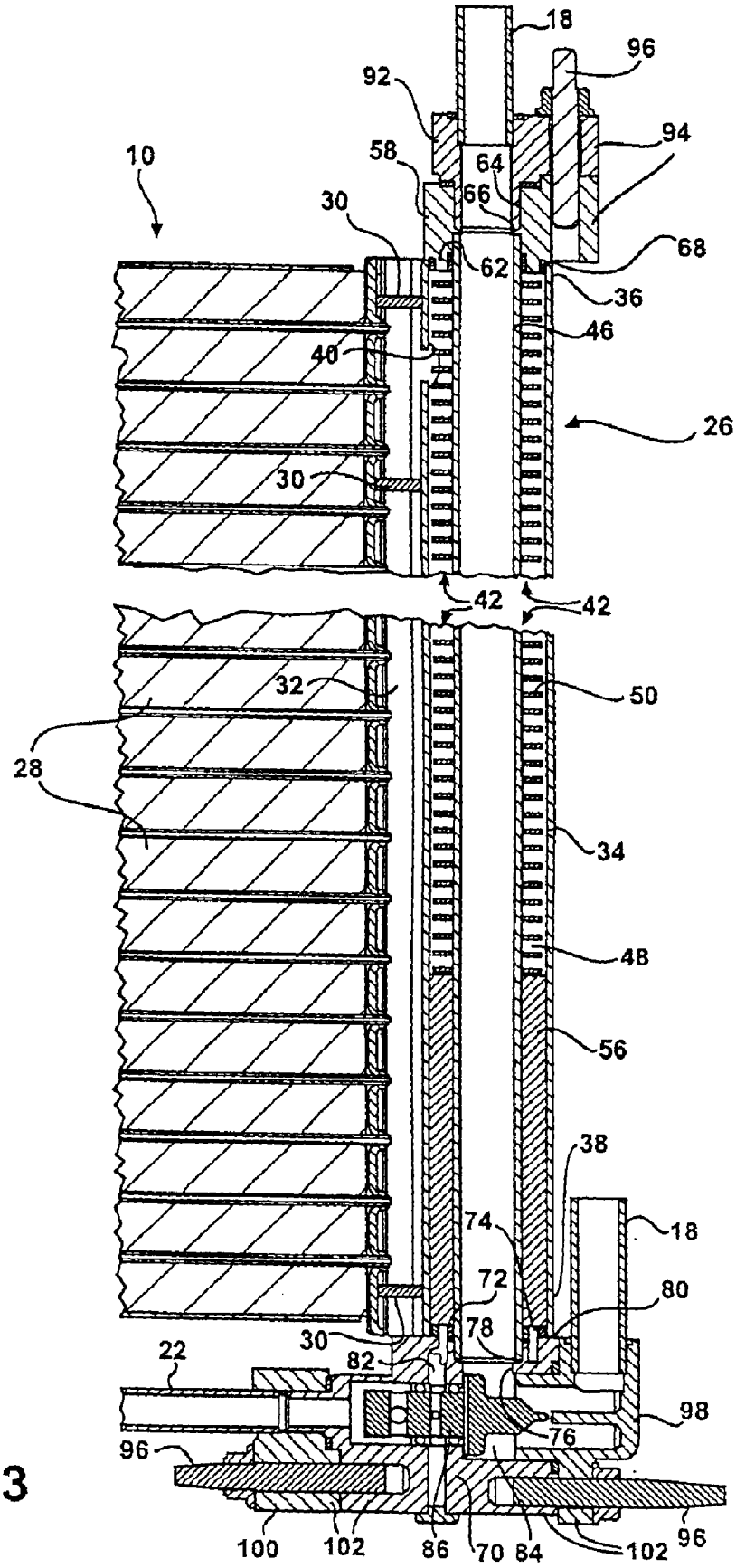
FIG. 3 is a partially cross-sectional side view of the multi-function condenser of FIG. 1.

Referring to FIG. 3, the second header 26 includes a header portion 32 and a receiver portion 34. The receiver portion 34 has a first end 36 and a second end 38 and preferably extends in parallel relationship along the header portion 32. A receiver inlet 40 extends between the second header 26 and the receiver portion 34 and is proximal to the first end 36 of the receiver portion 34. The receiver inlet 40 conveys refrigerant from the second header 26 into the receiver portion 34. The receiver inlet 40 is positioned adjacent to an end of the serpentine path of the refrigerant flow in the condenser 10. By including the receiver inlet 40 within the second header 26, a potential for leaks is avoided where the refrigerant flows from the condenser 10 to the receiver portion 34. The receiver portion 34 defines a receiver cavity 42 for receiving and storing the refrigerant from the header portion 32 for flowing into the evaporator 14 through the evaporator inlet line 22. Although it is not required, the condenser 10 is preferably positioned with the headers 24, 26 vertically disposed. The receiver inlet 40 is positioned at a top of the receiver portion 34 to fill the receiver cavity 42 and maintain a constant supply of refrigerant in the receiver cavity 42. A condenser inlet 44 is disposed in the first header 24. The condenser inlet 44 receives a flow of refrigerant from the compressor 16. The refrigerant flowing into the condenser 10 from the compressor 16 is superheated and would cause the refrigerant flowing in the receiver cavity 42 to boil if the condenser inlet 44 was positioned in the second header 26. Thus, the condenser inlet 44 must be positioned in the first header 24 to allow the refrigerant to make at least one pass through the tubes 28 before reaching the second header 26 such that the refrigerant is de-superheated. One pass through the tubes 28 is sufficient to cool the refrigerant flowing into the condenser 10 from the compressor 16 such that it will not boil the refrigerant flowing in the receiver cavity 42.

As shown in FIG. 3, the condenser 10 further includes a conduit 46. More specifically, the conduit 46 is a component of the suction line. The conduit 46 extends into and out of and is surrounded by the second header 26. A space 48 is defined between the conduit 46 and the second header 26 for receiving the refrigerant flowing into the receiver cavity 42 from the condenser 10. More specifically, the conduit 46 extends into and out of the receiver cavity 42. That is, in the subject invention, the vaporized refrigerant flowing through the suction line 18 is re-routed from the evaporator 14 through the receiver cavity 42 before flowing to the compressor 16. Preferably, as shown in FIG. 7, the receiver portion 34 defines a circular cross-sectional shape. Preferably, the conduit 46 also defines a circular cross-sectional shape and is concentric within the receiver cavity 42 to define the space 48 between the conduit 46 and the receiver portion 34. The conduit 46 is surrounded by the receiver portion 34. Refrigerant flows through the conduit 46 independently of refrigerant flowing in the space 48.

During operation of the air conditioning system 12, as the refrigerant vaporizes in the evaporator 14, pressure pulsations are generated in the refrigerant. The pressure pulsations travel through the refrigerant flowing through the suction line 18 and the conduit 46. The pressure pulsations create noise that may be audible outside of the air conditioning system 12. The conduit 46 attenuates the pressure pulsations in the refrigerant flowing through the conduit 46 to eliminate a need for a separate muffler, thus reducing cost for the air conditioning system 12.

The purpose of the conduit 46 passing through the receiver portion 34 is to transfer heat between the refrigerant flowing in the space 48 and the conduit 46. Refrigerant flowing from the evaporator 14 through the conduit 46, although vaporized, is at a much lower temperature than the refrigerant flowing through the space 48, which is in a liquid state, due to pressure differences between the refrigerant flowing in the conduit 46 and the refrigerant flowing in the space 48. In addition, with the receiver portion 34 extending in parallel to the header portion 32 of the second header 26, refrigerant flowing through the header portion 32 is also cooled, through the refrigerant in the space 48, by the refrigerant flowing in the conduit 46. The refrigerant flowing into the condenser 10 is super heated. The super heated refrigerant is cooled to de-superheat the refrigerant in a first pass through the tubes 28 before the refrigerant reaches the header portion 32 of the second header 26 to prevent the refrigerant from boiling the refrigerant flowing through the receiver portion 34. The refrigerant flowing through the header portion 32 of the second header 26 is not much hotter than the refrigerant flowing in the space 48. Thus, additional heat removal from the refrigerant flowing through the header portion 32 of the second header 26 increases an overall efficiency for the air conditioning system 12 and does not drastically raise a temperature of the refrigerant flowing through the space 48.

Referring to FIGS. 3 and 6, the conduit 46 includes a plurality of fins 50 spaced along and disposed transversely about an exterior of the conduit 46. The fins 50 aid in the transfer of heat in a heat exchanger by increasing a heat transfer surface area between fluid flows. Referring to FIG. 7, the fins 50 are generally annular in shape. Preferably the fins 50 define holes 52 to permit the refrigerant flowing in the space 48 to flow less hindered through the space 48, however, the holes 52 are not specifically required, and slots (not shown) may be defined by the fins 50 in place of the holes 52. Furthermore, an annular gap is defined between each fin 50 and the receiver portion 34 to allow the refrigerant to flow around the fin 50 and through the space 48.

Referring again to FIGS. 3 and 6, a desiccant 56 is disposed about the conduit 46 along a portion of a length of the conduit 46 in the space 48. The desiccant 56 dehydrates the refrigerant. Preferably, for the conduit 46 and the receiver portion 34 having circular cross-sectional shapes, the desiccant 56 is an annular desiccant cartridge, as is well known in the art.

A first end cap 58 is disposed at the first end 36 of the receiver portion 34 for closing the receiver portion 34 about the conduit 46 at the first end 36. The first end cap 58 provides an inlet into the conduit 46 for communication with the evaporator 14. The first end cap 58 includes a first male member 62 extending from the first end cap 58. The first male member 62 inserts into the first end 36 of the receiver portion 34 and extends into the receiver cavity 42 for sealing the receiver cavity 42 at the first end 36.

The first end cap 58 defines a first axial bore 64 through the first end cap 58. The conduit 46 partially extends into the first axial bore 64. The first axial bore 64 centers the conduit 46 in the receiver cavity 42 to ensure that the refrigerant flows uniformly around the conduit 46. The first end cap 58 further includes a first inner ledge 66 disposed within the first axial bore 64. The first inner ledge 66 abuts the conduit 46 when the conduit 46 extends into the first axial bore 64. The first inner ledge 66 defines an opening for conveying refrigerant into the conduit 46. The first end cap 58 further includes a first outer peripheral ledge 68 disposed about the first male member 62 for abutting the first end 36 of the receiver portion 34. The first inner ledge 66, the first outer peripheral ledge 68, and the first male member 62 simplify assembly of the condenser 10 by preventing the conduit 46 from being inserted too far into the first end cap 58 and by preventing the first end cap 58 from being inserted too far into the receiver cavity 42. Thus, the first inner ledge 66, the first outer peripheral ledge 68, and the first male member 62 inhibit a tendency toward misassembly of the condenser 10 by providing reference points for correct assembly.

A second end cap 70 is disposed at the second end 38 of the receiver portion 34. The second end cap 70 closes the receiver portion 34 about the conduit 46 at the second end 38. The second end cap 70 also provides outlets for communication with a compressor 16 and the evaporator 14. The second end cap 70 includes a second male member 72 extending from the second end cap 70. The second male member 72 inserts into the second end 38 of the receiver portion 34 and extends into the receiver cavity 42 for sealing the receiver cavity 42 at the second end 38. The second male member 72 defines a concentric groove 74 for allowing refrigerant to flow from the receiver cavity 42 to the evaporator 14.

The second end cap 70 defines a second axial bore 76 through the second end cap 70. The conduit 46 partially extends into the second axial bore 76. The second axial bore 76 centers the conduit 46 in the receiver cavity 42. The second end cap 70 further includes a second inner ledge 78 disposed within the second axial bore 76. The second inner ledge 78 abuts the conduit 46 when the conduit 46 extends into the second axial bore 76. The second inner ledge 78 defines an opening for conveying refrigerant out of the conduit 46. The second end cap 70 further includes a second outer peripheral ledge 80 disposed about the second male member 72 for abutting the second end 38 of the receiver portion 34. Like the first inner ledge 66, the first outer peripheral ledge 68, and the first male member 62 of the first end cap 58, the second inner ledge 78, the second outer peripheral ledge 80, and the second male member 72 aid in assembly of the condenser 10 by providing reference points for correct assembly.

Referring again to FIG. 3, the second end cap 70 defines a chamber 82 separate from the second axial bore 76. The chamber 82 receives refrigerant flowing from the concentric groove 74. The second end cap 70 further defines a third bore 84 transverse to and intersecting the second axial bore 76. The third bore 84, as described below, is designed to receive an expansion device 86.

Preferably, the first end cap 58 and the second end cap 70 are brazed onto the first end 36 and the second end 38, respectively. The first end cap 58 and the second end cap 70 are brazed adjacent the first male member 62 and second male member 72, respectively. The brazing process creates a durable seal that inhibits leakage from the receiver cavity 42 at the first end cap 58 and the second end cap 70. It is to be appreciated that alternative methods of attaching the first end cap 58 and the second end cap 70 are also possible.

The expansion device 86 is any device capable of expanding the refrigerant. Preferably, the expansion device 86 is a thermostatic expansion valve assembly (TXV) 86, although a fixed or variable orifice (not shown) may also be used. Although the TXV 86 is not required at the condenser 10, the particular embodiment disclosed in FIG. 3 includes the TXV 86 disposed within the third bore 84 of the second end cap 70. Alternatively, the TXV may be positioned in the evaporator inlet line 22, adjacent to the evaporator 14. The TXV 86 maintains separation between the refrigerant flowing in the second axial bore 76 and the refrigerant flowing in the chamber 82. If the TXV 86 is not disposed in the second end cap 70, a barrier, which is not shown, must be disposed in the third bore 84 between the second axial bore 76 and the chamber 82 to separate the refrigerant flowing through the second axial bore 76 and the refrigerant flowing through the chamber 82. The TXV 86 is in fluid communication with the chamber 82 to control the refrigerant flowing from the receiver cavity 42 to the evaporator 14.

Figure 4:
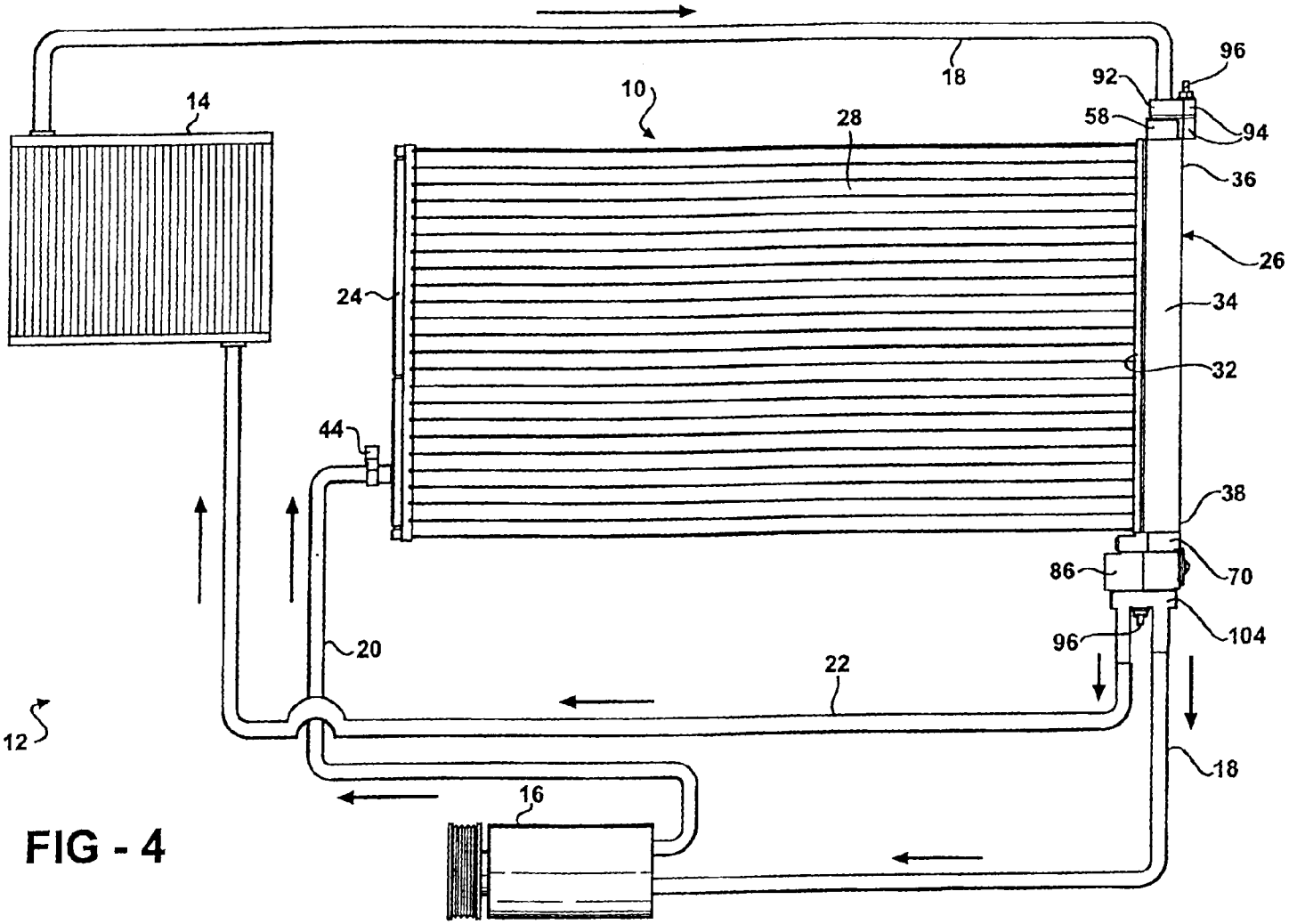
FIG. 4 is a schematic view of an air conditioning system illustrating a compressor, an evaporator, and an alternative embodiment of the multi-function condenser.
Figure 5:
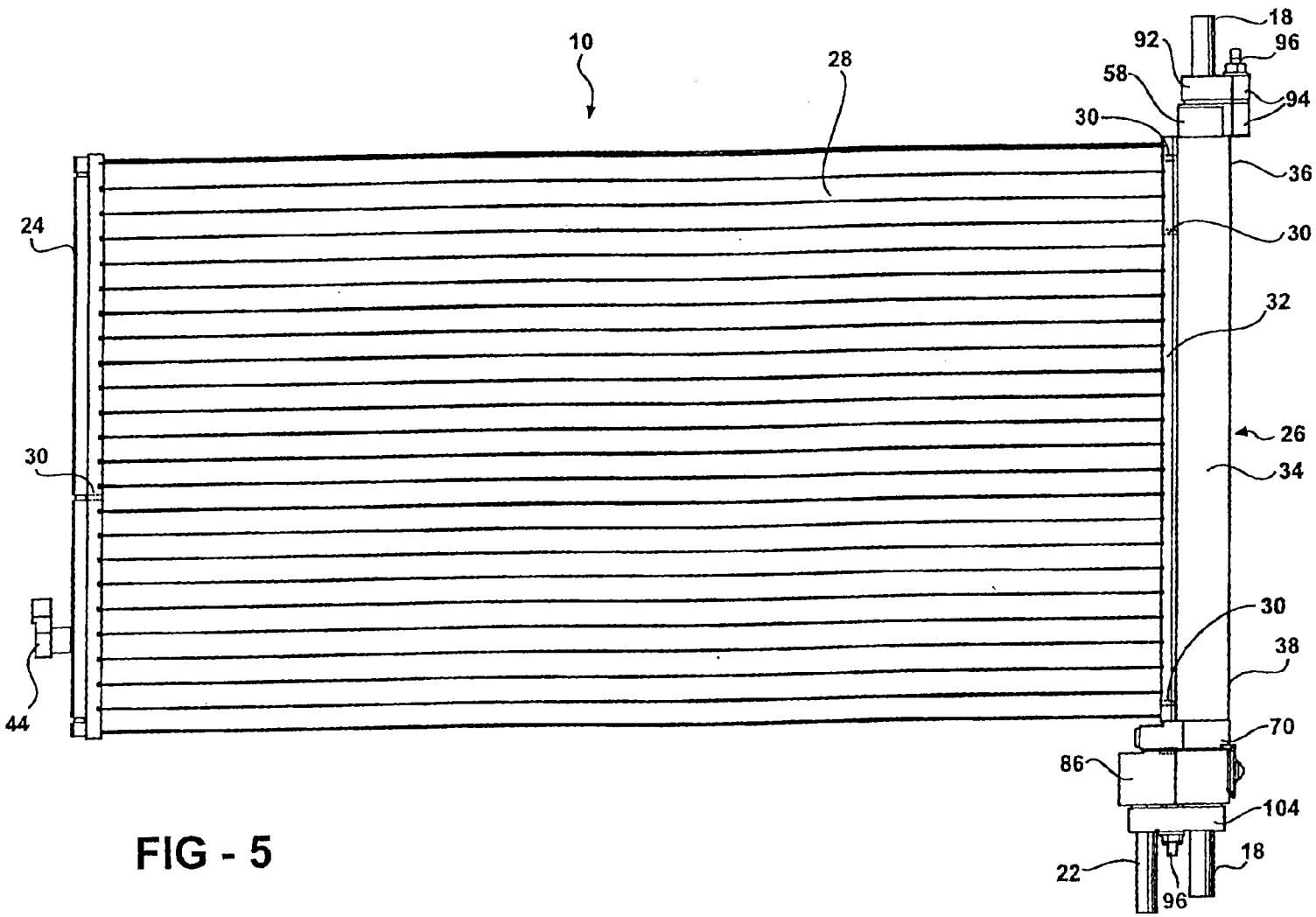
FIG. 5 is a front view of the alternative multi-function condenser of FIG. 4.

Alternatively, as shown in FIGS. 4–6, the TXV 86 is mounted to the second end cap 70. The TXV 86 defines a first channel 88 and a second channel 90. The first channel 88 and second channel 90 complement the chamber 82 and the second axial bore 76, respectively, for separately receiving the refrigerant flowing from the chamber 82 and the second axial bore 76. The TXV 86 is in fluid communication with the chamber 82 to control the refrigerant flowing from the receiver cavity 42 to the evaporator 14.

As is understood by those skilled in the art, the TXV 86 controls the refrigerant flowing from the receiver cavity 42 to the evaporator 14 by sensing or monitoring a superheat of the refrigerant that exits the evaporator 14 through the suction line 18, i.e., the conduit 46. Because the refrigerant from the evaporator 14 is returned back through the receiver portion 34, the TXV 86 can sense or monitor the superheat in the receiver cavity 42 and an external superheat sensing bulb is not required in the air conditioning system 12 to sense heat elsewhere.

A first end cap adapter 92 is coupled to the suction line 18. The first end cap adapter 92 engages the first end cap 58 for mounting the suction line 18 to the conduit 46 at the first end 36. Preferably, the first end cap 58 and the first end cap adapter 92 include complementary first end flanges 94 extending transverse to the first axial bore 64. Preferably, the first end flanges 94 define complementary holes for receiving a fastener 96 and for mounting the first end cap adapter 92 to the first end cap 58, however, it is to be appreciated that other fastening means are possible.

Referring to FIG. 3, a second end cap adapter 98 is coupled to the suction line 18. The second end cap adapter 98 engages the second end cap 70 for mounting the suction line 18 to the conduit 46 at the second end 38. A third end cap adapter 100 is coupled to the evaporator inlet line 22. The third end cap adapter 100 engages the second end cap 70 for mounting the evaporator inlet line 22 to the conduit 46 at the second end 38. More specifically, the second end cap adapter 98 and the third end cap adapter 100 are mounted to the second end cap 70 at the third bore 84 on opposite ends of the third bore 84. Preferably, the second end cap 70 and the second end cap adapter 98 include complementary second end flanges 102 extending transverse to the third bore 84. Preferably, the second end cap 70 and the third end cap adapter 100 include complementary second end flanges 102 extending transverse to the second axial bore 76. Preferably, the second end flanges 102 define complementary holes for receiving a fastener 96 and for mounting the second end cap adapter 98 to the second end cap 70 and for mounting the third end cap adapter 100 to the second end cap 70, however, it is to be appreciated that other fastening means are possible.

Alternatively, as shown in FIG. 6, a fourth end cap adapter 104 is coupled to the suction line 18 and to the evaporator inlet line 22. The fourth end cap adapter 104 engages the second end cap 70 for mounting the suction line 18 and the evaporator inlet line 22 to the conduit 46 at the second end 38. Preferably, the second end cap 70 and the fourth end cap adapter 104 define complementary holes for receiving a fastener 96 and for mounting the fourth end cap adapter 104 to the second end cap 70, however, it is to be appreciated that other fastening means are possible.

By including the first end cap adapter 92 and fourth end cap adapter 104 instead of fusing the suction line 18 to the first end cap 58 and the second end cap 70, respectively, the system 12 of the subject invention provides an accessibility advantage. The first end cap adapter 92 and the fourth end cap adapter 104 may be easily removed to access the receiver portion 34 and to remove and repair the condenser 10.

A method of assembling the condenser 10 is also proposed. In an optional fabricating step, the second header 26 is cut from a header tube preferably having a circular cross-sectional shape. More preferably, the second header 26 is cut from the header tube having the header portion 32 and the receiver portion 34 defining the receiver cavity 42.

In a mounting step, the second header 26 is mounted onto the condenser 10 having the first header 24 and the plurality of tubes 28. The second header 26 may be welded, snapped, brazed, or otherwise fused onto the condenser 10 to ensure that the second header 26 will not leak when receiving refrigerant under high pressure.

In a first end cap fusing step, the first end cap 58 is pressed and fused onto the second header 26 at the first end 36 of the receiver portion 34. The first male member 62 is inserted into the space 48 to correctly position the first end cap 58 on the first end 36. Preferably, the first end cap 58 is brazed onto the second header 26. Preferably, the first end cap fusing step is performed subsequent to the step of mounting the second header 26 onto the condenser 10. However, it is to be appreciated that the first end cap fusing step may be performed prior to the step of mounting the second header 26 onto the condenser 10.

In an optional cutting step, the conduit 46 is cut from a conduit tube preferably having a circular cross-sectional shape smaller than the receiver portion 34. In a fin fusing step that is also optional, a plurality of fins 50 are fused onto the conduit 46 in spaced relationship along and transversely about an exterior of the conduit 46. More specifically, the conduit 46 is inserted through the fins 50, which are annular in shape. The fins 50 are mounted to the conduit 46 through mechanical expansion of the conduit 46. The fins 50 may be mounted to the conduit 46 through other methods, such as welding, brazing, etc.

In an inserting step, the conduit 46 is inserted into the first axial bore 64 to center the conduit 46 in the receiver cavity 42. Preferably, the conduit 46 is inserted into the first axial bore 64 prior to the step of fusing the first end cap 58 onto the second header 26. The conduit 46 is pressed into the first axial bore 64 until the conduit 46 abuts the first inner ledge 66 disposed in the first end cap 58.

In a second end cap fusing step, the second end cap 70 is fused onto the second header 26 at the second end 38 of the receiver portion 34. Preferably, the second end cap 70 is brazed onto the second header 26. Preferably, the step of fusing the second end cap 70 onto the second header 26 occurs before the step of fusing the first end cap 58 onto the second header 26. Regardless of which end cap fusing step occurs first, only one of the first end cap fusing step and the second end cap fusing step can be performed before the step of inserting the conduit 46 through the second header 26.

In a desiccant inserting step, the desiccant 56 is placed in the receiver cavity 42. Preferably, the desiccant inserting step is performed prior to the step of inserting the conduit 46 into the second header 26, but may also be performed after the step of inserting the conduit 46 into the second header 26, in which case the desiccant inserting step is placed in the space 48 between the conduit 46 and the receiver portion 34.

For assembly of the embodiment as shown in FIG. 3, the TXV 86 is inserted into the second end cap 70 subsequent to the step of fusing the second end cap 70 onto the second end 38. The second end cap adapter 98, and the third end cap adapter 100 are mounted to the second end cap 70 and the first end cap adapter 92 is mounted to the first end cap 58 to connect the condenser 10 to the air conditioning system 12.

Alternatively, for the embodiment of FIG. 6, the TXV 86 is mounted to the second end cap 70, preferably after the step of fusing the second end cap 70 to the second end 38. The fourth end cap adapter 104 is mounted to the second end cap 70 and the first end cap adapter 92 is mounted to the first end cap 58 to connect the condenser 10 to the air conditioning system 12.

Obviously, many modifications and variations of the present invention are possible in light of the above teachings. The invention may be practiced otherwise than as specifically described within the scope of the appended claims.

What is claimed is:

1. An air conditioning system comprising an evaporator that supplies a flow of cool refrigerant, and a condenser further comprising: a first header; a second header; a plurality of tubes extending in parallel relationship between said headers for establishing fluid communication between said first header and said second header; and a conduit into which cool refrigerant from said evaporator flows, extending into and out of, and surrounded by said second header, to define a space there between, through which a higher temperature refrigerant flows, said space providing for heat transfer between said higher temperature refrigerant flow in said space and said cool refrigerant in said conduit as the cool refrigerant flows through said conduit independently of the higher temperature refrigerant flowing in said space.

2. A condenser as set forth in claim 1 wherein said second header includes a header portion and a receiver portion defining a receiver cavity.

3. A condenser as set forth in claim 2 wherein said receiver portion includes a first end and a second end and extending in parallel relationship along said header portion.

4. A condenser as set forth in claim 3 wherein said conduit extends into and out of said receiver cavity and is surrounded by said receiver portion to define said space therebetween.

5. A condenser as set forth in claim 4 wherein said conduit includes a plurality of fins spaced along and disposed transversely about an exterior of said conduit.

6. A condenser as set forth in claim 4 wherein said conduit defines a circular cross-sectional shape and is concentric within said receiver cavity to define said space between said conduit and said receiver portion.

7. A condenser as set forth in claim 4 further comprising a desiccant disposed about said conduit along a portion of a length thereof.

8. A condenser as set forth in claim 6 wherein said receiver portion defines a circular cross-sectional shape.

9. A condenser as set forth in claim 4 further comprising a first end cap disposed at said first end for closing said receiver portion about said conduit at said first end and for providing an inlet into said conduit for communication with an evaporator.

10. A condenser as set forth in claim 9 wherein said first end cap includes a first male member extending from said first end cap for inserting into said first end of said receiver portion and defines a first axial bore through said first end cap with said conduit partially extending into said first axial bore for centering said conduit in said receiver cavity.

11. A condenser as set forth in claim 10 wherein said first end cap further includes a first inner ledge disposed within said first axial bore for abutting said conduit and for defining an opening for conveying refrigerant into said conduit.

12. A condenser as set forth in claim 9 wherein said first end cap further includes a first outer peripheral ledge disposed about said first male member for abutting said receiver portion.

13. A condenser as set forth in claim 9 further comprising a second end cap disposed at said second end for closing said receiver portion about said conduit at said second end and for providing outlets for communication with a compressor and the evaporator.

14. A condenser as set forth in claim 13 wherein said second end cap includes a second male member extending from said second end cap for inserting into said second end of said receiver portion with said second male member defining a concentric groove for allowing refrigerant to flow from said receiver cavity to the evaporator and further defining a second axial bore through said second end cap with said conduit partially extending into said second axial bore for centering said conduit in said receiver cavity.

15. A condenser as set forth in claim 14 wherein said second end cap further includes a second inner ledge disposed within said second axial bore for abutting said conduit and defining an opening for conveying refrigerant out of said conduit.

16. A condenser as set forth in claim 13 wherein said second end cap further includes a second outer peripheral ledge disposed about a base of said second male member for abutting said receiver portion.

17. A condenser as set forth in claim 14 wherein said second end cap defines a chamber separate from said second axial bore for receiving refrigerant from said concentric groove.

18. A condenser as set forth in claim 17 wherein said second end cap defines a third bore transverse to and intersecting said second axial bore.

19. A condenser as set forth in claim 18 further including an expansion device disposed within said third bore for maintaining separation between the refrigerant flowing in said second axial bore and the refrigerant flowing in said chamber and for controlling the refrigerant flowing from said receiver cavity to the evaporator.

20. A condenser as set forth in claim 19 further comprising a receiver inlet extending between said second header and said receiver portion for conveying refrigerant from said second header to said space in said receiver cavity.

21. A condenser as set forth in claim 20 wherein said receiver inlet is proximal to said first end of said receiver portion.

22. A condenser as set forth in claim 21 further comprising a plurality of dividers disposed in said first header and said second header for dividing said tubes into groups for directing refrigerant flow in a serpentine path through said tubes between said headers and into said receiver inlet.

23. A condenser as set forth in claim 17 further including an expansion device mounted to said second end cap and defining a first channel and a second channel complementing said chamber and said second axial bore, respectively, for separately receiving the refrigerant flowing from said chamber and said second axial bore.

24. A condenser as set forth in claim 1 further comprising a condenser inlet in said first header for receiving refrigerant flowing from a compressor.

25. An air conditioning system comprising: an evaporator for vaporizing and cooling the refrigerant flowing into said evaporator; a compressor for pressurizing the refrigerant flowing into said compressor; a suction line disposed between said evaporator and said compressor for flowing refrigerant from said evaporator to said compressor; a condenser for condensing the refrigerant flowing into said condenser; a pressurized refrigerant line disposed between said compressor and said condenser for flowing refrigerant from said compressor to said condenser, an evaporator inlet line disposed between said condenser and said evaporator for flowing refrigerant from said condenser to said evaporator; a first header mounted to said condenser; a second header mounted to said condenser opposite said first header; a plurality of tubes extending in parallel relationship between said headers for establishing fluid communication between said first header and said second header; and said suction line including a conduit extending into and out of, and surrounded by said second header to define a space there between for transferring heat between a cool refrigerant flowing into said second header and through said conduit, and a refrigerant flowing through said space, said cool refrigerant flowing through said conduit independently of the refrigerant flowing through said space.

26. A system as set forth in claim 25 wherein said second header includes a header portion and a receiver portion defining a receiver cavity.

27. A system as set forth in claim 26 wherein said receiver portion includes a first end and a second end and extending in parallel relationship along and engaging said header portion.

28. A system as set forth in claim 27 wherein said conduit extends into and out of said receiver cavity and is surrounded by said receiver portion to define said space therebetween.

29. A system as set forth in claim 28 further comprising a first end cap disposed at said first end for closing said receiver portion about said conduit at said first end and for providing an inlet into said conduit for communication with said evaporator.

30. A system as set forth in claim 29 further comprising a second end cap disposed at said second end for closing said receiver portion about said conduit at said second end and for providing outlets for communication with said compressor and said evaporator.

31. A system as set forth in claim 30 further comprising a first end cap adapter coupled to said suction line and engaging said first end cap for mounting said suction line to said conduit at said first end.

32. A system as set forth in claim 31 further comprising a fourth end cap adapter coupled to said suction line and said evaporator inlet line and engaging said second end cap for mounting said suction line and said evaporator inlet line to said conduit at said second end.

33. A system as set forth in claim 31 further comprising a second end cap adapter coupled to said suction line and engaging said second end cap for mounting said suction line to said conduit at said second end.

34. A system as set forth in claim 33 further comprising a third end cap adapter coupled to said evaporator inlet line and engaging said second end cap for mounting said evaporator inlet line to said conduit at said second end.

* * * * *